United States Patent [19]

Muir

[11] Patent Number: 4,973,055

[45] Date of Patent: Nov. 27, 1990

[54] TENNIS NET CENTER STRAP AND MEASURING DEVICE

[76] Inventor: David Muir, 12631 Greenwood Ave., Blue Island, Ill. 60406

[21] Appl. No.: 387,849

[22] Filed: Jul. 31, 1989

[51] Int. Cl.[5] ..... A63B 61/00

[52] U.S. Cl. ..... 273/29 BA; 24/625

[58] Field of Search ..... 273/29 BA; 24/627, 628, 24/629, 630, 631, 632, 634, 635, 636

[56] References Cited

U.S. PATENT DOCUMENTS

| | | | |
|---|---|---|---|
| 1,351,066 | 8/1920 | Robinson | 273/29 BA |
| 1,534,447 | 4/1925 | Hardy | 273/29 BA |
| 3,549,146 | 12/1970 | Davis | 273/29 BA |
| 4,247,099 | 1/1981 | Pandak | 273/29 BA |
| 4,671,509 | 6/1987 | Newmann | 273/29 BA |
| 4,831,694 | 5/1989 | Kong | 24/635 |

FOREIGN PATENT DOCUMENTS

| | | | |
|---|---|---|---|
| 190006 | 12/1922 | United Kingdom . | |
| 516402 | 1/1940 | United Kingdom | 273/29 BA |
| 2138879 | 10/1984 | United Kingdom | 24/634 |

*Primary Examiner*—Theatrice Brown

*Attorney, Agent, or Firm*—Leydig, Voit & Mayer

[57] ABSTRACT

A tennis net center strap with an integral measuring device for adjusting and maintaining the top of a tennis net at a selected height above a tennis court surface. The tennis net center strap is preferably made from two strips of material, one end of the first strip being connected to the first part of a quick release mechanism having a serrated slot therein for receiving the free end of the second strip. A fastener including a hook surface and a loop surface is located on the second strip, the hook and loop surfaces being lockably engageable after the second strip is threaded through the second part of the quick release mechanism and folded back on itself.

15 Claims, 3 Drawing Sheets

TENNIS NET CENTER STRAP AND MEASURING DEVICE

Field Of The Invention

The present invention relates generally to tennis net equipment, and more particularly to straps for adjusting the height of a tennis net. The present invention also comprehends a portable net strap with an integral measuring device to ensure that the center of the net is always positioned at a height 36 inches above the playing surface of the tennis court.

Background Of The Invention

A tennis court is divided across the middle by a net, which is suspended from a cord or metal cable, the ends of which are attached to two end posts, one on each side of the court. As defined by the Rules of Tennis, the height of the net cannot exceed 36 inches above the tennis court surface at its center point. The rules stipulate that the strap should be no more than 2 inches in width and completely white in color.

During play, the net should be maintained tautly at the prescribed height, since a lesser measure will allow shots that should be unsuccessful to clear the net. On the other hand, a measure exceeding 36 inches will deprive a player of a shot the rules of the game declare should be his. Even a slight deviation of ¼ inch or ½ inch can make a significant difference in scoring over the course of a game.

Many devices have been proposed for use as center net straps. Pandak U.S. Pat. No. 4,247,099 discloses one such device. It comprises a single length of strapping having a Velcro fastener adjacent to each end. A snap hook, or other suitable mechanism, is disposed between the two ends of the strap and connects the strap to the tennis court mount. The strap is passed over the top of the net, and the Velcro surfaces forming the fastener are then engaged so as to maintain the net at the desired height. Although simple in design and construction, the Pandak strap has proven deficient in holding the net at 36 inches over an extended period of time. The loop and hook surfaces of the Velcro fastener may become worn and stretched, and rain may cause those surfaces to loosen. Moreover, the impact of the tennis ball hitting the net tends to disengage the hook and loop surfaces, and thus impairs the holding power of the strap once installed.

The strap in Pandak incorporates a measuring device placed along one side of the strap for use in setting the height of the net. There is, however, no provision in the Pandak patent for securing the free end of the strap after a measurement has been made. Because the free end of the strap remains unsecured, it can become soiled and abraded during the course of a tennis match. Should the ends of the strap fray, the strap may no longer provide an accurate measurement.

Newman, in U.S. Pat. No. 4,671,509, shows another design of a tennis net strap. A loop is placed at an intermediate position along the strap; this loop holds a fastener for connecting the strap device to a mount in the tennis court surface. After positioning the strap around the net, one of the free ends of the strap is threaded through a connecting buckle and doubled back upon itself. A hook and loop fastener on the surface of the doubled-back portion of the strap is then engaged to secure the strap in a closed position. A serrated buckle retains the free end of the doubled-back portion of the strap. Like Pandak, the hook and loop fastener in Newman must be completely disengaged when removing the strap from around the net. In Newman, this entails unthreading the free end of the strap through the serrated buckle and then through the connecting buckle. Unthreading the strap through the latter is made more difficult by the presence of the hook and loop fastener. Repeated use of the strap will cause abrasion of this fastening surface, thereby diminishing the holding power of the fastener and causing slippage over time.

The strap in Newman also lacks a measuring device to ensure the top of the net is set at 36 inches above the playing surface. Without an integral means for measuring the height of the net, one must resort to a yard stick or other measuring device, something a player can easily forget to bring to a match. The need for a yardstick or other measuring device is aggravated by the fact that the strap must be rethreaded each time it is removed and reinstalled. The strap cannot be left in a "36-inch position."

Robinson, in U.S. Pat. No. 1,351,066, reveals an adjustable tennis net strap with a buckle device, a link mount and an anchoring chain. Robinson has several limitations: First, it cannot be used on a hard court where a strap mount is already located in the tennis court surface without damaging the surface of the court since the anchoring chain is to be driven into the court a distance of several inches. Second, while Robinson incorporates a 36-inch measure, a player must measure and subtract the distance of the link mount above the court to set the net at the prescribed height.

Hardy U.S. Pat. No. 1,534,447 discloses a strap and attaching buckle for securing the center of the net to a tennis court mount.

Davis U.S. Pat. No. 3,549,146 shows a measuring rod which may be used to locate the proper height of the tennis net. As with Robinson, this device would be difficult to use on a court with a hard surface since Robinson incorporates an anchoring member which must be set in the playing surface.

A preferred tennis net strap should be adaptable to different tennis court surfaces and different mounting arrangements. While many tennis courts feature mounts at the center of the court to secure the strap, the point at which the strap is attached to the mount may be above, at, or below the surface of the playing court, depending upon the construction of the mount. The tennis net strap should therefore be adjustable to accommodate deviations in mounts from court to court, as well as any change in the length of the strap due to wear or exposure to sun and rain, or other factors that could cause the strap to lengthen or contract.

A preferred tennis net strap should also include a measuring device so that the height of the net can be easily and conveniently set at 36 inches above the playing surface. The strap should also securely maintain the net at the prescribed height, and should not loosen or become disengaged due to weather or other factors. In addition, the strap should be easily adjustable and removable so that players who wish to remove the strap at the conclusion of a tennis match may do so.

SUMMARY OF THE INVENTION

A general object of the invention is to provide a portable tennis net center strap which is usable on any tennis court having a mount at the center of the court surface.

It is a further object of the invention to provide a tennis net center strap which is easily and quickly mounted on the tennis net by means of a quick release connection, and which may be easily repaired if damaged.

It is a further important object of the invention to provide a tennis net center strap which will maintain the tennis net securely at the prescribed height, and which will not lengthen or slip over time. It is a related of the invention to provide a tennis net center strap which is easily adjustable, and which includes a measuring device, so that the height of the net may be positioned at 36 inches or any other preselected height without the use of an external measuring device such as a yardstick.

In accordance with the present invention, these objects are realized by a tennis net center strap comprising a readily-openable buckle to facilitate the installation and removal of the strap from around the net, a locking arrangement that will maintain the height of the tennis net at 36 inches, and an integral measuring device. The invention may be used on any tennis court with a built-in mount. Other objects and advantages of the invention will become apparent upon studying the following description and accompanying drawings.

The present invention comprehends a tennis net center strap comprising an elongated loop formed of two strips of material: a first strip and a folded strip. At the first end of each strip is an opening. One end of a double-ended fastening means, such as a snap hook, is secured through both openings. The other end of the fastener is connected to the tennis court mount, thereby attaching the tennis net center strap to the court surface. The second end of the first strip terminates in one part of a two-part quick-release connecting means, such as a quick-release buckle.

The second end of the folded strip is threaded through the second portion of the quick release buckle and doubled back upon itself. A Velcro fastener is provided adjacent the first and second ends of the doubled-back strip so that when the parts of the quick release buckle are engaged, the Velcro surfaces of the folded strip are in face-to-face relation. When both the buckle and the Velcro fastener are engaged, the entire strap comprises an unbroken loop which will hold the net tautly at a preselected height above the surface of the tennis court. In accordance with the invention, a third strip of material is interwoven through a plurality of openings in the first strip, and is marked to serve as a measuring tape. The measuring tape allows for easy measurement of the height of the net while the tennis net strap is being secured in position.

The strap and measuring tape are constructed or formed of any suitable material such as a synthetic fabric selected from the group consisting of polyester, polyethylene, and nylon. Stitching may be used to form the loop which holds the quick release buckle, although other fastening means such as rivets may also be employed. Stiching may also be used to secure the Velcro fasteners to the folded strip, and to reinforce the edges of the openings in the first strip which hold the measuring tape in place. Those skilled in the art will also appreciate that the openings in the strips may be reinforced by metal grommets or other suitable reinforcing means.

While this invention has been disclosed primarily in terms of a specific embodiment thereof, it is not intended to be limited thereto. Other modifications and embodiments will be apparent to those skilled in this art.

DESCRIPTION OF THE PREFERRED EMBODIMENT

Figure 1:
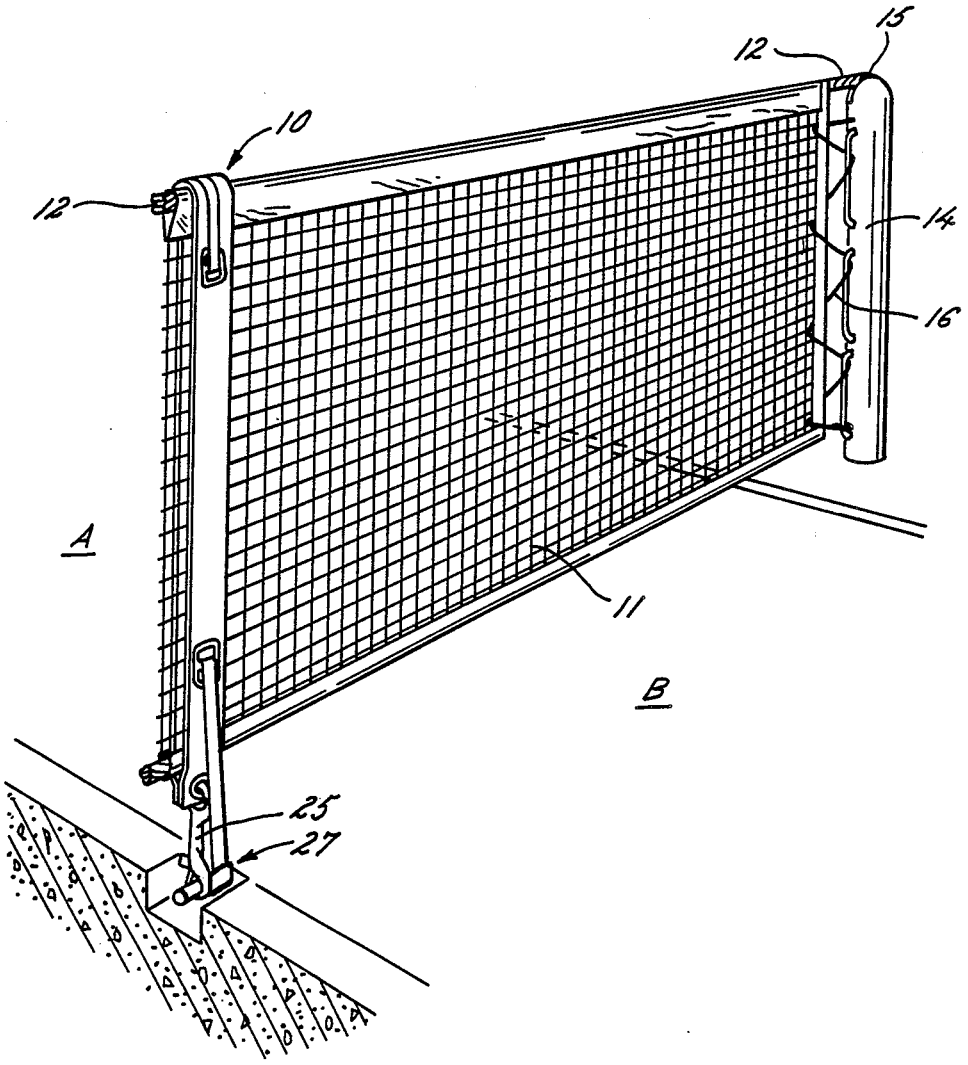
FIG. 1 is a pictorial representation, partly in cross-section, of a portion of a tennis court and illustrates the center strap of the present invention.

The tennis net center strap device according to the present invention is shown generally as 10 in FIG. 1. The tennis net 11 divides the tennis court into two halves, A and B, and is suspended from a cord 12, which is attached to the top 15 of posts 14 located at either side of the tennis court. Cord lacing 16 is used to attach the side edges of net 11 to posts 14 and acts together with cord 12 to maintain the suspended net in a taut position.

At the center of the tennis court, and embedded within the surface of the court, is the tennis court mount 27. The tennis net center strap 10 encircles the net 11 and is connected to the mount 27 so that the net is immobilized and is maintained at a preselected height above the court.

Figure 2:
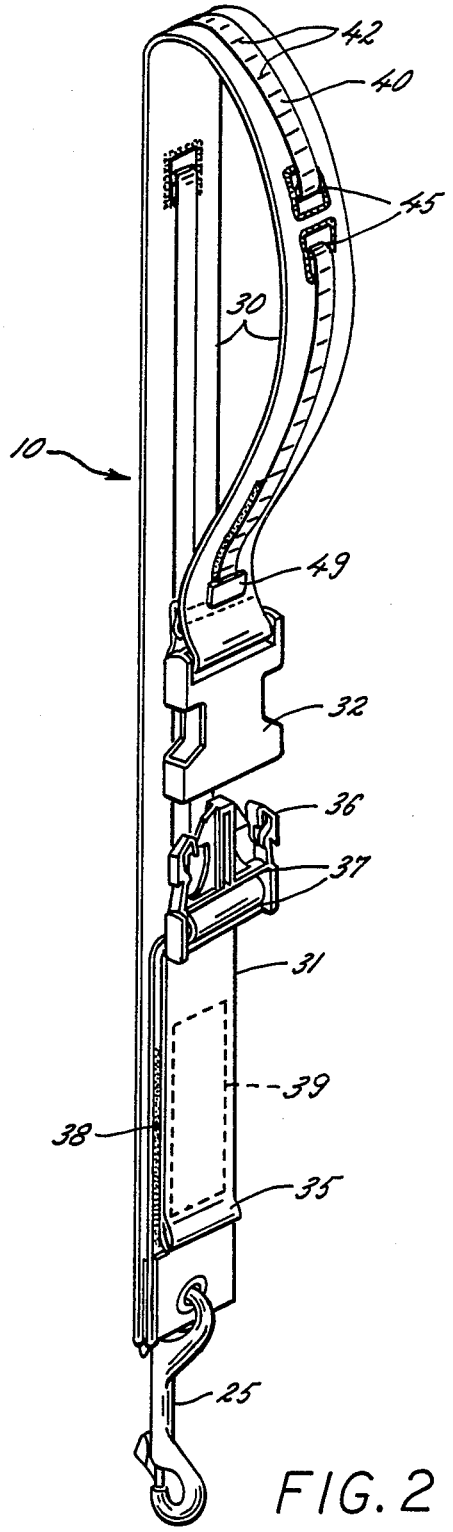
FIG. 2 is a pictorial representation of the center strap of the present invention with the quick release buckle disengaged and the measuring device in a retracted position.

FIG. 2 shows the buckle side of strap 10, the tennis net having been removed to display the strap device more clearly. One end of an anchor hook 25, such as a doubled-ended snap hook, is used to attach the strap to the tennis court mount 27. The other end of anchor hook 25 engages openings in one end of a first strip 30 and a doubled-back strip 31. The openings, as shown, are reinforced by grommets. The other end of first strip 30 terminates in a loop and is connected to the first portion 32 of a quick release buckle such as the female portion of a friction clasp as shown in FIG. 2.

As previously described, one end of the doubled-back strip 31 is fastened to anchor hook 25. The opposite end, as best shown in FIG. 2, terminates in free end 35. The free end 35 is threaded through slots 37 of the second part 36 of the buckle, and strip 31 is then folded back upon itself. The second part 36 of the buckle preferably has a serrated surface in at least one of the slots 37 to engage: strip 31 and to hold strip 31 securely in place.

Figure 3:
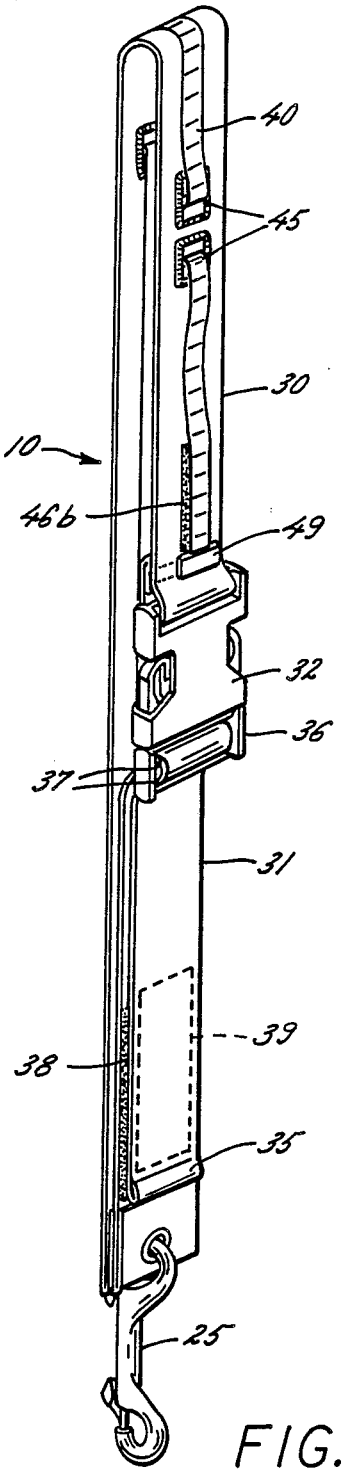
FIG. 3 is a view similar to FIG. 2, but showing the quick release buckle is in the closed and engaged position.

A fastening means, such as a hook and loop fastener commonly known as Velcro, is used to secure free end 35. The hook surface 38 is affixed to doubled-back strip 31 on a portion of the strip near the end attached to anchor hook 25. The loop surface 39 is attached to a portion of the strip 31 near free end 35. In this way, free end 35 may be extended through the second part 36 of the buckle and folded or doubled-back along strip 31. The length of the tennis net center strap 10 can be adjusted by this movement, and once the strap is adjusted to the proper height, the Velcro fastener and the buckle, together, will hold the strap securely in place. FIG. 3 is similar to FIG. 2 except the first and second parts of the buckle have been closed to form a continuously closed loop of material which surrounds the net 11.

Figure 4:
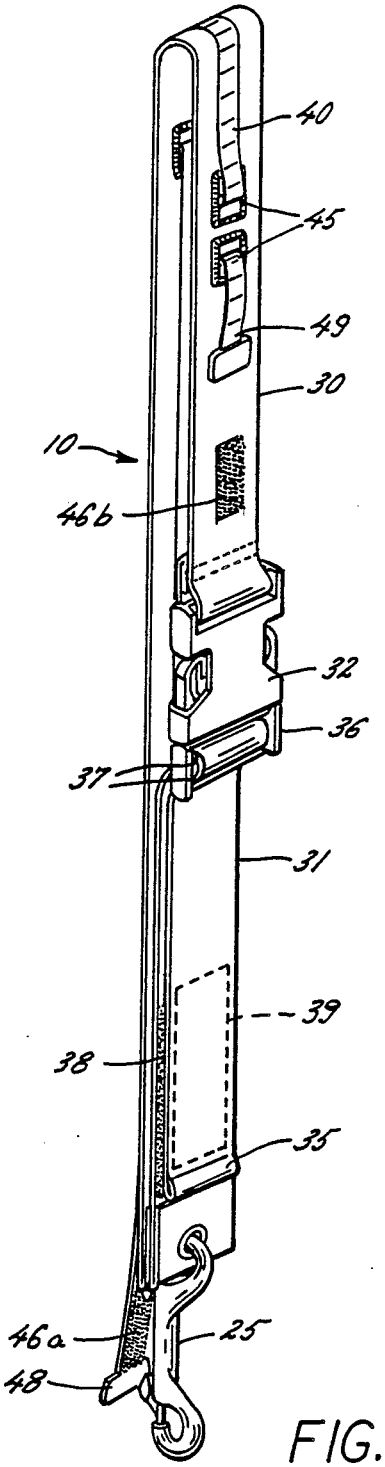
FIG. 4 is similar to FIG. 3, but with the measuring device extended to touch the surface of the tennis court.
Figure 5:
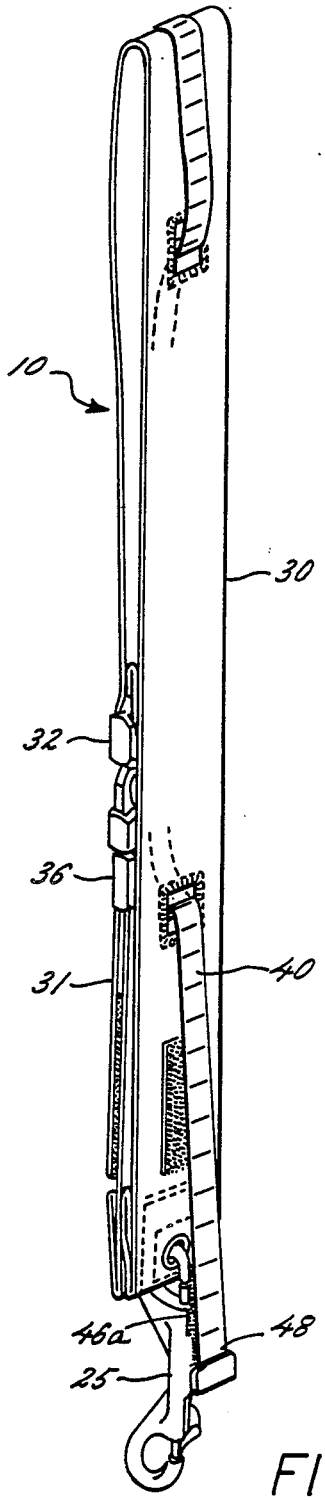
FIG. 5 is similar to FIG. 4, but shows the reverse side of the tennis net strap according to the present invention.

As shown in both FIGS. 2 and 3, a measuring tape 40 is woven through the first strip 30 through a plurality of slits 45. The lower-end of measuring device 40 emerges along the outside of the first strip, near the anchor hook 25. The upper-end of measuring tape 40 emerges along the outside of the strap 10 near the top of the net, so that the measuring device may pass over and be visible from the top of the net. Fastening means 46*a* are provided at the ends of the tape 40 and are engageable with complementary fastening means 46*b* on strip 30 for securing the measuring device when not in use. Positioned along the measuring tape 40 are a plurality of markings 42, which may be set in inches or some other appropriate measure. The first end 48 of the tape 40 may be pulled down to touch the tennis court surface, as illustrated in FIG. 4. This movement will result in the second end 49 of the tape 40 moving up the strap as reflected by a comparison of FIG. 4 with FIG. 3. FIG. 5 shows the reverse side of strap 10 with the measuring tape 40 in the lowered position so as to touch the court surface.

To place the tennis net strap around a tennis net, buckle parts 32 and 36 are released to open the strap. The net is then placed between first strip 30 and doubled-back strip 31. The upper portion of first strip 30, which terminates in the first part 32 of the buckle, is passed over the top of net 11 and the buckle portions 32 and 36 are then closed so that strap 10 is one long continuous loop. At this time, anchor hook 25 is fastened to tennis court mount 27.

Measuring tape 40 is then pulled down until it touches the surface of the tennis court. The free end 35 of doubled-back strip 31 is pulled away from the adjacent portion of strip 31 so that the Velcro surfaces 38 and 39 are disengaged and open. The height of the net 11 is then set by adjusting the upper portion of the first strip 30 until the preselected measurement mark 42 of measuring tape 40 (generally a mark reflecting a height of 36 inches) lies precisely on top of net 11. The doubled-back portion of strip 31 is adjusted to take up any slack in the strap or threaded through buckle 36 to ease the tension on the strap, and Velcro surfaces 35 and 36 are engaged. In this way, the strap 10 will pull the net 11 tautly down so that its top is at the proper height, and will maintain that height while the strap is in place.

Since the strap assembly 10 is portable, it can be easily detached from the tennis court mount 27 and the net 11 after a tennis match is concluded by the players. The players may then store the strap or carry it to another tennis court. Those skilled in the art will also appreciate that each strip of the tennis net strap may be replaced separately in the event that one of the strips becomes damaged and must be repaired. In addition, the tennis net strap, because of its readily adjustable nature, may be used with a variety of tennis court mounts, which are located above, at or below the surface of the tennis court. Those skilled in the art, however, will appreciate that a single strip of material may be used to accomplish the objectives of the present invention, rather than the two strips described in this specification in connection with the preferred embodiment.

The tennis net center strap of present invention is easily adjustable and features a quick release buckle to facilitate the installation and removal of the strap from around the net. As can be readily appreciated, the strap can be installed or removed by means of the buckle mechanism, without removing the Velcro fastener affixing the free end 35 to doubled-back strip 31, so that little if any adjustment of the strap need be made when the strap is removed and then reinstalled on the same court or one with a similar mounting arrangement. The measuring tape 40 also provides an easy and convenient means for a player to accurately and quickly adjust the height of the net.

What is claimed is:

1. A tennis net center strap for adjusting and maintaining the top of a tennis net at a selected height above a tennis court surface, the tennis court having a mount located at its center point to secure said strap device, the tennis net center strap comprising:

an elongated loop of material for encircling the tennis net, said material comprising a first strip having a loop at one end and an opening at the other, and a second strip having an opening at one end and extending from said opening to a free end, the openings in the first and second strips being connected to said mount so that one of said first and second strips may be extended over the top of the tennis net;

a quick release mechanism having two parts for joining the first and second strips to position the center strap around the tennis net, the first part of said quick release mechanism being attached to said loop end of said first strip, and the second part of said quick release mechanism having at least one slot therein for threadably receiving therethrough said free end of said second strip;

said second part of said quick release mechanism having a serrated surface associated with said slot for engaging and retaining said second strip; and fastening means including a hook surface and a loop surface on said second strip, one of said surfaces being adjacent said free end of said second strip, the other surface being spaced apart therefrom on the same side of the strip, which surfaces are lockably engageable after said second strip is threaded through said second part of said quick release mechanism and folded back on itself to secure the free end of said second strip.

2. The tennis net center strap of claim 1 in which the first and second strips are connected to the mount by a double-ended snap hook.

3. The tennis net center strap of claim 2 in which one end of the snap hook is attached to the first and second strips through the openings therein.

4. The tennis net center strap of claim 1 in which the first strip is extended over the top of the net.

5. The tennis net center strap of claim 1 in which the quick release mechanism is a friction clasp having a female portion and a second mating portion which may be quickly and easily disengaged, one from the other.

6. The tennis net center strap of claim 1 in which the hook and loop surfaces of the second strip are spaced one from the other on the same side of the strip and secured thereto.

7. The tennis net center strap of claim 1 in which grommits are employed to reinforce the openings in the first and second strips.

8. The tennis net center strap of claim 1 in which a measuring device having at least one indicator marking is incorporated therein, said marking corresponding, to the selected height of the tennis net.

9. A tennis net center strap for adjusting and maintaining the top of a tennis net at a selected height above a tennis court surface, the tennis court having amount located at its center point to secure said strap device, the tennis net center strap comprising:

an elongated loop of material for encircling the tennis net, said material comprising a first strip having a loop at one end and an opening at the other, and a second strip having an opening at one end and extending from said opening to a free end, the openings in the first and second strips being connected to said mount so that one of said first and second strips may be extended over the top of the tennis net;

a quick release mechanism having two parts for joining the first and second strips to position the center strap around the tennis net, the first part of said quick release mechanism being attached to said loop end of said first strip, and the first part of said quick release mechanism having at least one slot therein for receiving therethrough said free end of said second strip;

said second part of said quick release mechanism having a serrated surface associated with said slot for engaging said second strip;

fastening means including a hook surface and a loop surface on said second strip, which surfaces are lockably engageable after said second strip is threaded through said second part of said quick release mechanism and folded back on itself; and a measuring device comprising an elongated length of material having first and second ends and at least one indicator marking located therebetween, said measuring device being slidably interwoven in said one of said first and second strips extending over the top of the tennis net such that said measuring device is visible at the top of the net and said first and second ends extend downwardly therefrom, said measuring device being movable with respect to the tennis net strap so that said first end may be brought in to contact with the surface of the tennis court, said tennis net center strap being adjustable to position said at least one indicator marking atop the tennis net when the first end of the measuring device is flush with the tennis court surface.

10. The tennis net center strap of claim 9 in which said at least one indicator marking is located 36 inches from said first end of said measuring device.

11. The tennis net center strap of claim 9 in which securing means comprising complementary mating hook and loop fastening surfaces are located on said one of said first and second strips extending over the top of the net and said first and second ends of said measuring device for securing the measuring device on said tennis net center strap once the top of the tennis net is set at the selected height.

12. A tennis net center strap comprising:

an elongated strip of material having a loop end and a free end; a loop end formed in the strip between the loop end and the free end thereof; connecting means engageable with said loop for attaching said tennis net center strap to a tennis court mount; a quick release mechanism having two parts for joining the loop end and free end of the strip to position the center strap around the tennis net; the first part of said quick release mechanism being attached to said loop end of said strip, and the second part of said quick release mechanism having at least one slot therein for threadably receiving therethrough said free end; said second part of said quick release mechanism having a serrated surface associated with said slot for engaging said strip; fastening means including a hook surface and a loop surface, one of said surfaces being secured adjacent the free end of the strip, the other surface being spaced apart therefrom on the same side of the strip and secured thereto; said hook and loop surface being lockably engageable after said free end is threaded through said second part of said quick release mechanism and folded back on itself; and a measuring device comprising an elongated length of material having first and second ends and at least one indicator marking located therebetween, said measuring device being slidably interwoven in said strip and extending over the top of the tennis net such that said measuring device is visible at the top of the net and said first and second ends extend downwardly therefrom, said measuring device being movable with respect to the tennis net strap so that said first end may be brought in to contact with the surface of the tennis court, said tennis net center strap being adjustable to position at least one indicator marking atop the tennis net when the first end of the measuring device is flush with the tennis court surface.

13. The tennis net center strap of claim 12 in which a measuring device having at least one indicator marking is incorporated therein, said marking corresponding to the selected height of the tennis net above the tennis court surface.

14. A tennis net center strap comprising an elongate strip of material having a loop end and a free end; a loop formed in the strip between the loop end and the free end thereof; connecting means engageable with said loop for attaching said tennis court center strap to a tennis court mount; a quick release mechanism having two parts for joining a loop end and free end of the strip to position the center strap around the tennis net; the first part of said quick release mechanism being attached to said loop end of said strip, and the second pat of said quick release mechanism having at least two slots therein for threadably receiving therethrough said free end; fastening means including a hook surface and a loop surface, one of said surfaces being secured adjacent the free end of the strip, the other surface being spaced apart therefrom on the same side of the strip and secured thereto; said hook and loop surfaces being lockably engageable after said free end is threaded through said slots of said second part of said quick release mechanism and folded back on itself; and a measuring device comprising an elongated length of material having first and second ends and at least one indicator marking located therebetween, said measuring device being slidably interwoven in said strip and extending over the top of the tennis net such that said measuring device is visible at the top of the net and said first and second ends extend downwardly therefrom, said measuring device being movable with respect to the tennis net strap such that said first end may be brought in to contact with the surface of the tennis court, said tennis net center strap being adjustable to position said at least one indicator marking atop the tennis net when the first end of the measuring device is flush with the tennis court surface.

15. A tennis net center strap for adjusting and maintaining the top of the tennis net at a selected height above a tennis court surface, the tennis court having a mount located at its center point to secure said strap device, the tennis net center strap comprising:

an elongated loop of material for encircling the tennis net, said material comprising a first strip having a loop at one end and an opening at the other, and a second strip having an opening at one end and extending from said opening to a free end, the openings in the first and second trips being connected to said mount so that one of said first and second strips may be extended over the top of the tennis net;

a quick release mechanism having two parts for joining the first and second strips to position the center strap around the tennis net, the first part of said quick release mechanism being attached to said loop end of said first strip, and the second part of said quick release mechanism having at least two slots therein for threadably receiving therethrough said free end of said second strip;

fastening means including a hook surface and a loop service on said second strip, one of said surfaces being adjacent said free end of said second strip, the other surface being spaced apart therefrom on the same side of the strip, which surfaces are lockably-engageable after said second strip is threaded through said slots of said quick release mechanism and folded back on itself to secure the free end of said second strip, said slots also securing said second strip when the tennis net center strap is maintained in tension;

a measuring device comprising an elongated length of material having first and second ends and at least one indicator marking located therebetween, said measuring device being slidably interwoven in said one of said first and second strips extending over the top of the tennis net such that said measuring device is visible at the top of the net and said first and second ends extend downwardly therefrom said measuring device being movable with respect to the tennis net strap so that said first end may be brought in to contact with the surface of the tennis court, said tennis net center strap being adjustable to position said at least one indicator marking atop the tennis net when the first end of the measuring device is flush with the tennis court surface.

* * * * *